US011021980B2

(12) United States Patent
Ols et al.

(10) Patent No.: US 11,021,980 B2
(45) **Date of Patent: *Jun. 1, 2021**

(54) GAS TURBINE ENGINE TURBINE VANE RING ARRANGEMENT

(71) Applicant: Raytheon Technologies Corporation, Farmington, CT (US)

(72) Inventors: John T. Ols, Northborough, MA (US); Steven D. Porter, Wethersfield, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 421 days.

This patent is subject to a terminal disclaimer.

(21) Appl. No.: 16/391,544

(22) Filed: Apr. 23, 2019

(65) Prior Publication Data

US 2020/0024995 A1 Jan. 23, 2020

Related U.S. Application Data

(63) Continuation of application No. 14/907,003, filed as application No. PCT/US2014/043110 on Jun. 19, 2014, now Pat. No. 10,344,603.

(60) Provisional application No. 61/859,844, filed on Jul. 30, 2013.

(51) Int. Cl.

| | |
|---|---|
| ***F01D 9/04*** | (2006.01) |
| ***F01D 11/00*** | (2006.01) |
| ***F01D 11/02*** | (2006.01) |
| ***F01D 25/16*** | (2006.01) |

(52) U.S. Cl.

CPC ..... *F01D 9/041* (2013.01); *F01D 11/003* (2013.01); *F01D 11/02* (2013.01); *F01D 25/162* (2013.01); *F05D 2240/14* (2013.01); *F05D 2260/37* (2013.01)

(58) Field of Classification Search

CPC ..... F01D 9/041; F01D 11/02; F01D 11/003; F01D 15/162

See application file for complete search history.

(56) References Cited

U.S. PATENT DOCUMENTS

| | | | |
|---|---|---|---|
| 3,182,955 | A | 5/1965 | Hyde |
| 5,077,035 | A | 12/1991 | Wieland et al. |
| 5,451,116 | A | 9/1995 | Czachor et al. |
| 5,634,767 | A | 6/1997 | Dawson |
| 6,095,750 | A | 8/2000 | Ross et al. |

(Continued)

FOREIGN PATENT DOCUMENTS

| | | |
|---|---|---|
| EP | 2182177 | 5/2010 |
| EP | 2192274 A2 | 6/2010 |

(Continued)

OTHER PUBLICATIONS

International Search Report and Written Opinion for PCT Application No. PCT/US2014/043110, dated Feb. 9, 2015.

(Continued)

*Primary Examiner* — Eldon T Brockman
*Assistant Examiner* — Topaz L. Elliott
(74) *Attorney, Agent, or Firm* — Carlson, Gaskey & Olds, P.C.

(57) ABSTRACT

A vane pack for a gas turbine engine includes an annular arrangement of vanes. A ring is secured around the vanes and extends proud of an axial end of the vanes.

20 Claims, 4 Drawing Sheets

(56) References Cited

U.S. PATENT DOCUMENTS

| | | | | |
|---|---|---|---|---|
| 6,343,912 | B1 * | 2/2002 | Manteiga | F01D 9/042 415/138 |
| 6,464,453 | B2 | 10/2002 | Toborg et al. | |
| 6,821,087 | B2 | 11/2004 | Matsumoto et al. | |
| 8,099,962 | B2 | 1/2012 | Durocher et al. | |
| 8,206,094 | B2 * | 6/2012 | Seki | F01D 5/225 415/191 |
| 8,347,500 | B2 * | 1/2013 | Durocher | F01D 25/243 29/889.2 |
| 8,454,304 | B2 * | 6/2013 | Heriz Agiriano | F01D 9/065 415/142 |
| 8,469,661 | B2 | 6/2013 | Durocher et al. | |
| 8,500,392 | B2 * | 8/2013 | Durocher | F01D 9/06 415/116 |
| 8,511,969 | B2 * | 8/2013 | Durocher | F01D 25/28 415/115 |
| 8,740,557 | B2 | 6/2014 | Durocher | |
| 9,127,559 | B2 | 9/2015 | Lord et al. | |
| 9,194,252 | B2 | 11/2015 | Farah et al. | |
| 9,243,500 | B2 | 1/2016 | Zelesky et al. | |
| 9,394,915 | B2 | 7/2016 | Gordon et al. | |
| 9,631,517 | B2 | 4/2017 | Liles et al. | |
| 2006/0233642 | A1 * | 10/2006 | Wunderlich | F01D 11/18 415/209.2 |
| 2007/0098545 | A1 | 5/2007 | Alvanos et al. | |
| 2009/0208332 | A1 | 8/2009 | Weinstein et al. | |
| 2009/0238683 | A1 | 9/2009 | Alvanos et al. | |
| 2010/0135786 | A1 | 6/2010 | Manteiga et al. | |
| 2010/0166545 | A1 * | 7/2010 | Schuler | F01D 25/06 415/189 |
| 2011/0081239 | A1 | 4/2011 | Durocher | |
| 2011/0081240 | A1 * | 4/2011 | Durocher | F01D 9/044 415/209.3 |
| 2012/0274034 | A1 | 11/2012 | Bouchard et al. | |
| 2012/0282087 | A1 * | 11/2012 | Lord | F01D 25/246 415/208.1 |
| 2013/0004319 | A1 | 1/2013 | Lee et al. | |

FOREIGN PATENT DOCUMENTS

| | | |
|---|---|---|
| WO | 2014052007 | 4/2014 |
| WO | 2014171994 | 10/2014 |

OTHER PUBLICATIONS

European Search Report for European Patent Application No. 14832509.5 dated Mar. 1, 2017.

International Preliminary Report on Patentability for PCT Application No. PCT/US2014/043110, dated Feb. 11, 2016.

European Examination Report for European Application No. 14832509.5 dated May 14, 2019.

* cited by examiner

GAS TURBINE ENGINE TURBINE VANE RING ARRANGEMENT

CROSS-REFERENCE TO RELATED APPLICATIONS

This disclosure is a continuation of U.S. patent application Ser. No. 14/907,003, filed on Jan. 22, 2016, which is a National Stage Entry of PCT Application No. PCT/US2014/043110, filed on Jun. 19, 2014, which claims priority to U.S. Provisional Application No. 61/859,844, which was filed on Jul. 30, 2013.

BACKGROUND

This disclosure relates to a gas turbine engine vane arrangement, for example, in a turbine section. More particularly, the disclosure relates to a ring used to secure circumferentially arranged vanes to one another in, for example, a mid-turbine frame.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

Both the compressor and turbine sections may include alternating series of rotating blades and stationary vanes that extend into the core flow path of the gas turbine engine. For example, in the turbine section, turbine blades rotate and extract energy from the hot combustion gases that are communicated along the core flow path of the gas turbine engine. The turbine vanes, which generally do not rotate, guide the airflow and prepare it for the next set of blades.

A mid-turbine frame is arranged axially between high and low turbine sections. One type of mid-turbine frame uses discrete vanes secured circumferentially to one another to provide an integral annular vane pack. The vane pack is reinforced using multiple rings secured to the vanes. An edge of the vane pack is disposed within a pocket of rotating blades of an adjacent turbine stage to provide a seal at the inner flow path. The reinforcement ring at this location is spaced from and outside of the pocket.

SUMMARY

In one exemplary embodiment, a vane pack for a gas turbine engine includes an annular arrangement of vanes. A ring is secured around the vanes and extends proud of an axial end of the vanes.

In a further embodiment of any of the above, the annular arrangement includes vane segments secured to one another circumferentially.

In a further embodiment of any of the above, the ring is secured to the vanes by mechanical elements.

In a further embodiment of any of the above, the mechanical elements include at least one of a braze, a weld and fasteners.

In a further embodiment of any of the above, the ring is secured to the vanes by an interference fit.

In a further embodiment of any of the above, the ring and the vanes include interlocking features that engage one another and are configured to prevent relative axial movement between the ring and the vanes.

In a further embodiment of any of the above, the ring is secured to an inner platform.

In a further embodiment of any of the above, the axial end is a leading edge.

In a further embodiment of any of the above, the ring provides an end configured to provide a seal with an adjacent rotating component.

In a further embodiment of any of the above, the end includes one of an annular pocket and an annular lip.

In another exemplary embodiment, a gas turbine engine includes a compressor section. A combustor is fluidly connected downstream from the compressor section. A turbine section is fluidly connected downstream from the combustor and includes high and low pressure turbine sections. A vane pack is arranged in one of the compressor or turbine sections. The vane pack includes a ring secured around an annular arrangement of vanes and extends proud of an axial end of the vanes to an end. The end interleaves with an adjacent rotating component to provide a seal.

In a further embodiment of any of the above, the vane pack is arranged in the turbine section.

In a further embodiment of any of the above, the rotating components include one of a pocket and a lip. The ring provides the other of the pocket and the lip. The lip is arranged in the pocket to provide the seal.

In a further embodiment of any of the above, the stage of rotating blades is provided by the high pressure turbine section. The vane pack provides a mid-turbine frame.

In a further embodiment of any of the above, the engine static structure supports a sealing ring that engages the reinforcement ring.

In a further embodiment of any of the above, the annular arrangement includes vane segments secured to one another circumferentially.

In a further embodiment of any of the above, the vanes are discrete from one another and hung from engine static structure.

In a further embodiment of any of the above, the reinforcement ring is secured to the vanes by at least one of a mechanical element and an interference fit.

In a further embodiment of any of the above, the reinforcement ring is secured to an inner platform.

In a further embodiment of any of the above, the axial end is a leading edge.

BRIEF DESCRIPTION OF THE DRAWINGS

The disclosure can be further understood by reference to the following detailed description when considered in connection with the accompanying drawings wherein.

DETAILED DESCRIPTION

Figure 1:
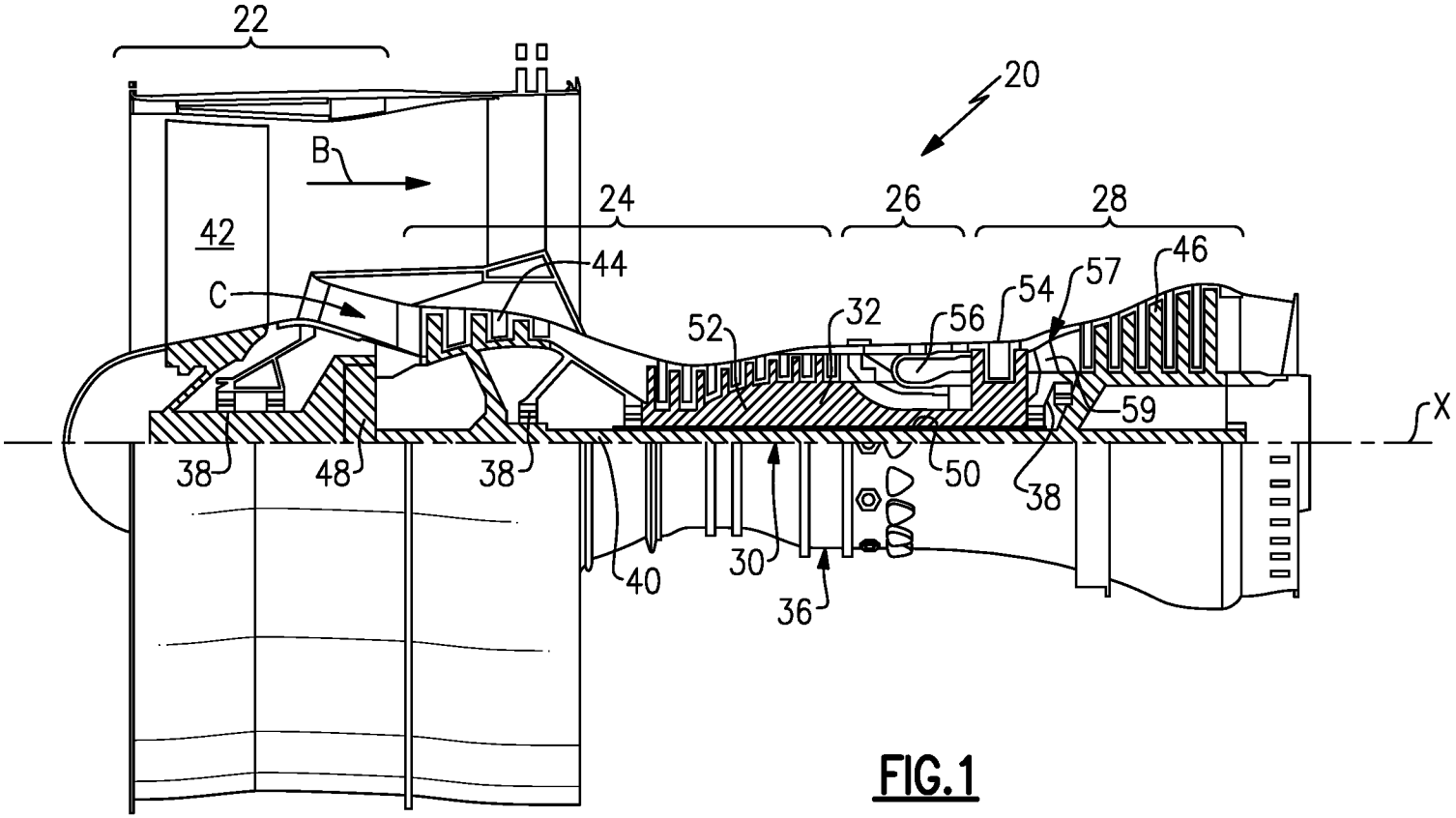
FIG. 1 schematically illustrates a gas turbine engine embodiment.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high temperature exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan with or without a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis X relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis X.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about five (5). The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 57 of the engine static structure 36 is arranged generally between the high pressure turbine 54 and the low pressure turbine 46. The mid-turbine frame 57 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 57 includes vanes 59, which are in the core airflow path and function as an inlet guide vane for the low pressure turbine 46. Utilizing the vane 59 of the mid-turbine frame 57 as the inlet guide vane for low pressure turbine 46 decreases the length of the low pressure turbine 46 without increasing the axial length of the mid-turbine frame 57. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC)"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed", as disclosed herein according to one non-limiting embodiment, is less than about 1150 ft/second.

Figure 2:
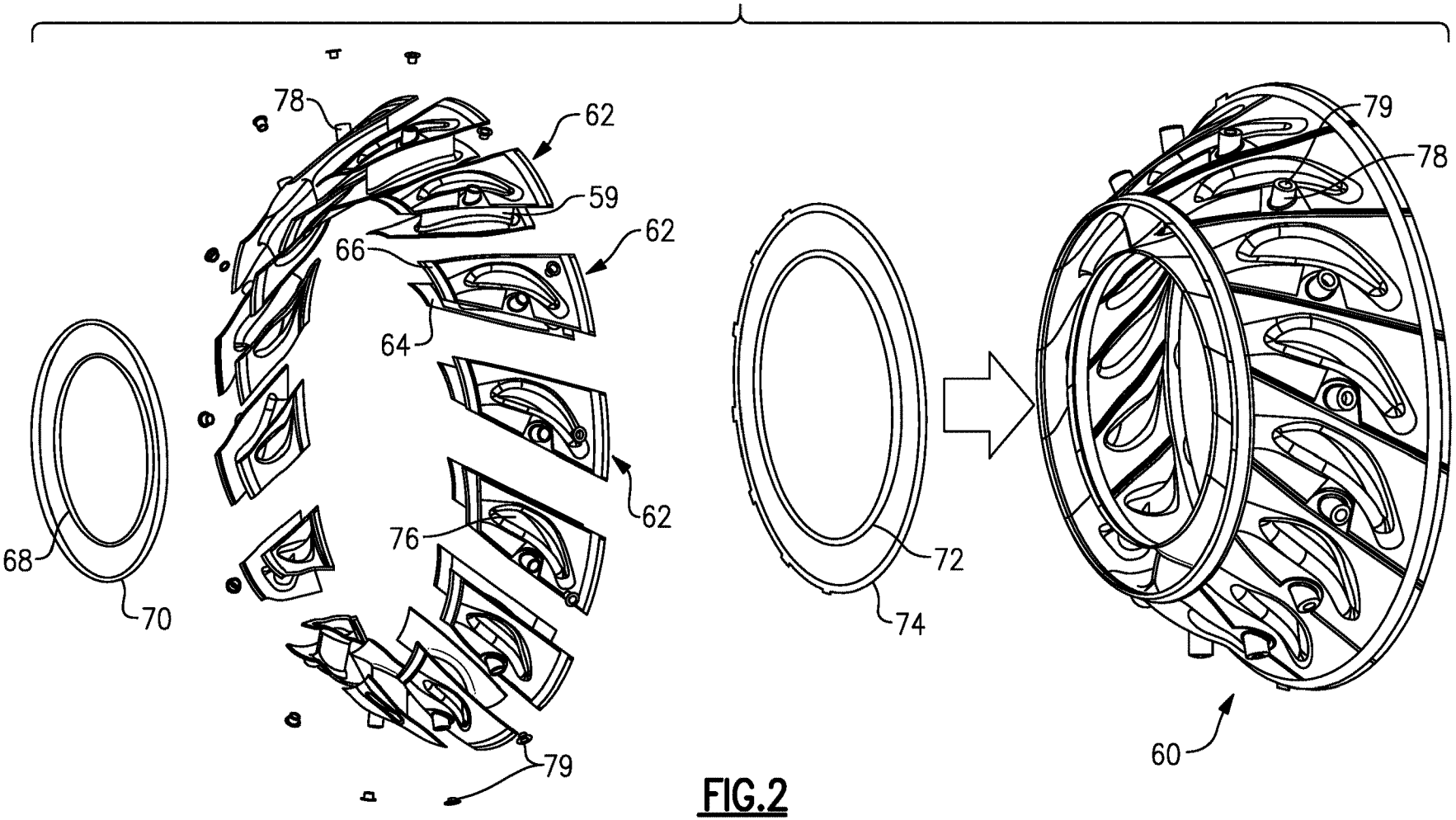
FIG. 2 is an exploded perspective view of a mid-turbine frame vane pack.

An exploded view of a vane pack 60 is illustrated in FIG. 2. The vane pack 60 provides a gas path portion of the mid-turbine frame 57 in one example gas turbine engine. The vane pack may be provided in other sections of the engine 20, such as the compressor section and other areas of the turbine section. In one example, the vane pack 60 is provided by multiple vane segments 62 circumferentially arranged and secured with respect to one another to provide an annular structure. Each vane 62 includes an inner and outer platform 64, 66 joined to one another by the vane airfoil 59.

In one example, the vanes 62 are constructed from a nickel alloy and brazed to one another. Forward inner and outer diameter rings 68, 70 and aft inner and outer diameter rings 72, 74 are secured to the vane segments 62 for structural reinforcement. In one example, the rings 68, 70, 72, 74 are secured to the vane segments 62 by brazing.

Although multiple discrete circumferential vane segments are shown in FIG. 2, it should be understood that a cast and/or machined structure may provide clusters of vanes or all of the vanes and associated inner and outer platforms in a single, unitary annular configuration.

In one example, the vane airfoils 59 provide a hollow cavity 76 that accommodate oil lines, structural members, wires, bleed air conduits or other elements that may be passed from the outer portion of the engine static structure 36 to an inner portion.

Figure 3:
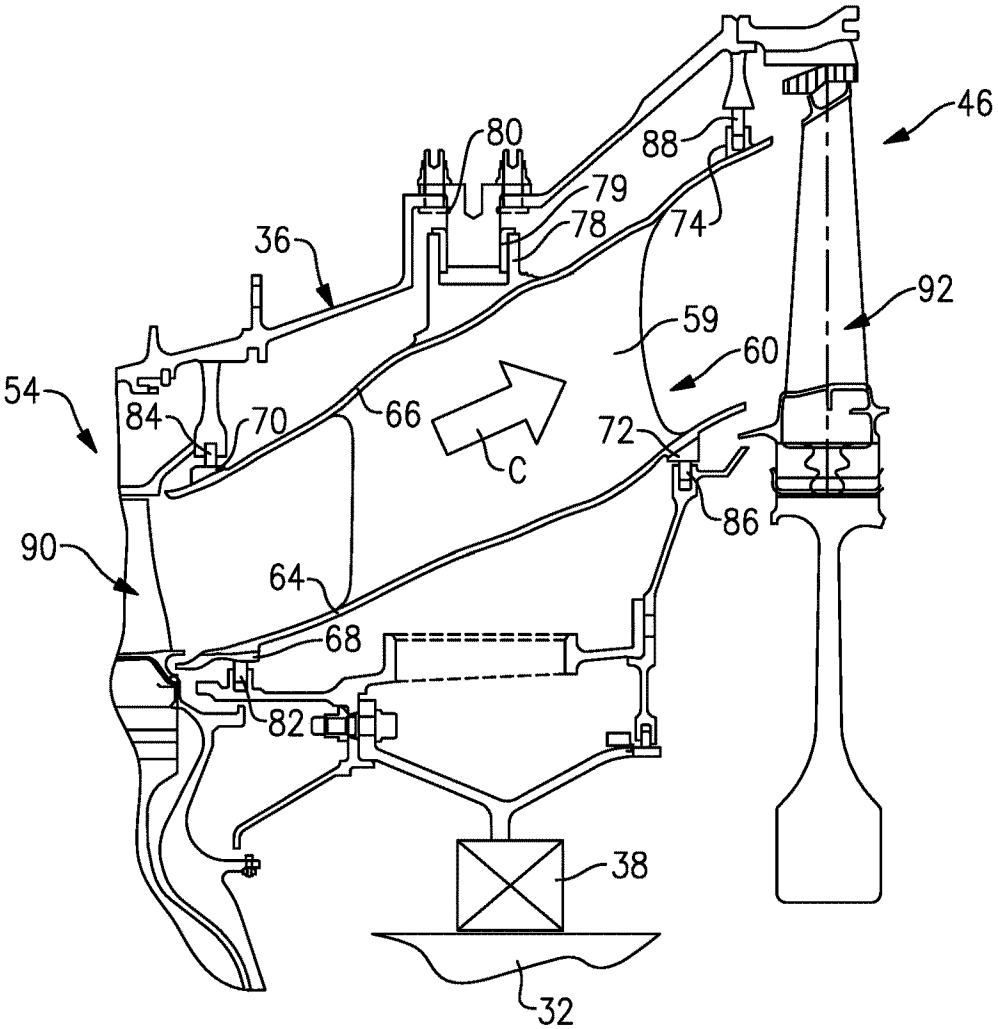
FIG. 3 is a cross-sectional view of the mid-turbine frame vane pack arranged between the high and low turbine sections.

Referring to FIGS. 2 and 3, the vanes 62 includes a boss 78 that receives a bushing 79. A pin 80 is secured to the engine static structure 36 and received by the bushing 79 to locate the vane pack 60 with respect to the engine static structure 36. Engine static structure 36 supports one of the bearings 38 mounted to the high pressure turbine shaft 32.

First, second, third and fourth sealing rings 82, 84, 86, 88 are supported by the engine static structure 36 and respectively engage the forward inner and outer diameter ring 68, 70 and the aft inner and outer diameter ring 72, 74 to seal the flow path gases within the core flow path C from other components.

Figure 4:
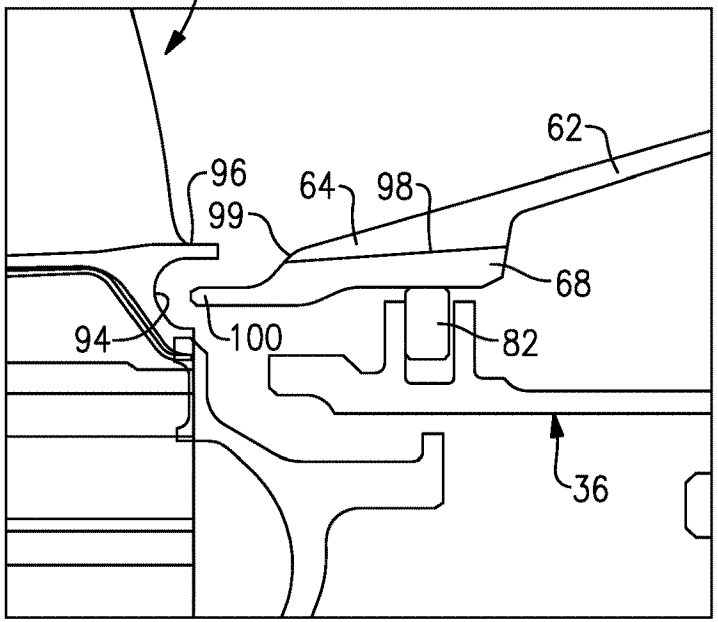
FIG. 4 is an enlarged view of a reinforcing ring of the vane pack arranged adjacent to rotating blades.

As shown in FIGS. 3 and 4, the high pressure turbine section 54 includes an aft stage blade 90, which includes a pocket 94. The forward inner diameter ring 68 includes an end 100 secured around the vanes 60 that extends proud of an axial end of the vanes, in the example the leading edge 99 of the inner platform 64. The end 100 provides an annular lip that is arranged at least partially within the pocket 94 and radially beneath the blade platform 96. The forward inner diameter ring 68 is secured to the main segments 62 at an interface 98 by brazing, for example, if one or more of the vane segments 62 begins to separate from the forward inner diameter ring 68, the vane segments 62 will not physically interfere with the rotation of the aft stage blade 90.

The low pressure turbine section 46 includes a forward stage blade 92. In the example, the aft inner diameter ring 72 does not extend beyond the vane segment 62 as does the forward inner diameter ring 68, since there is more clearance between the vane segments 62 and the forward stage blade 92. However, an end of the forward outer diameter ring 70 and aft inner and outer diameter rings 72, 74 may extend axially beyond the vane segments 62 if desired where running clearances are tighter.

Figure 5:
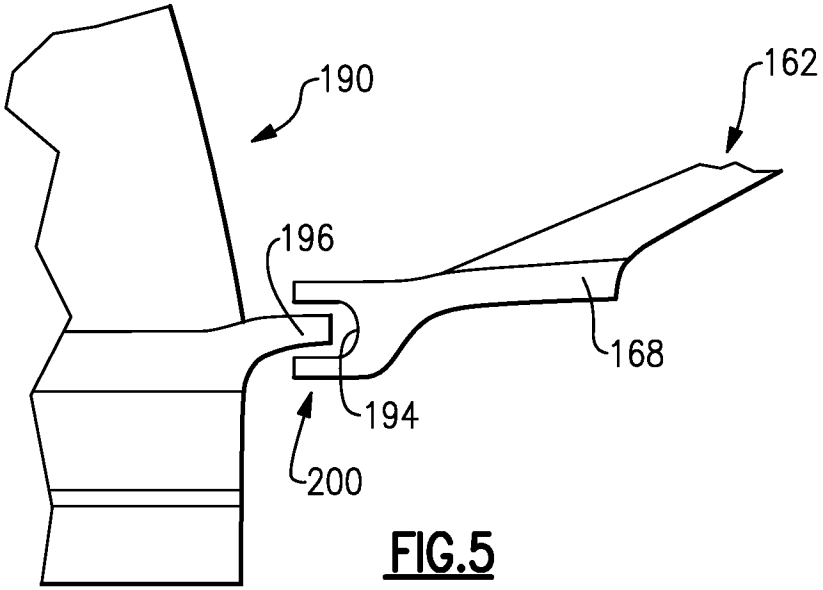
FIG. 5 is an enlarged view of another ring configuration adjacent to another blade.

In the example shown in FIG. 5, the blade 190 includes a platform 196 having a lip received in an annular pocket 194 provided by the end 200 of the ring 168, which is secured to the vane 162. Thus, it should be understood that the platform and end may include any geometry suitable for providing a seal between the blade and vane.

Figure 6:
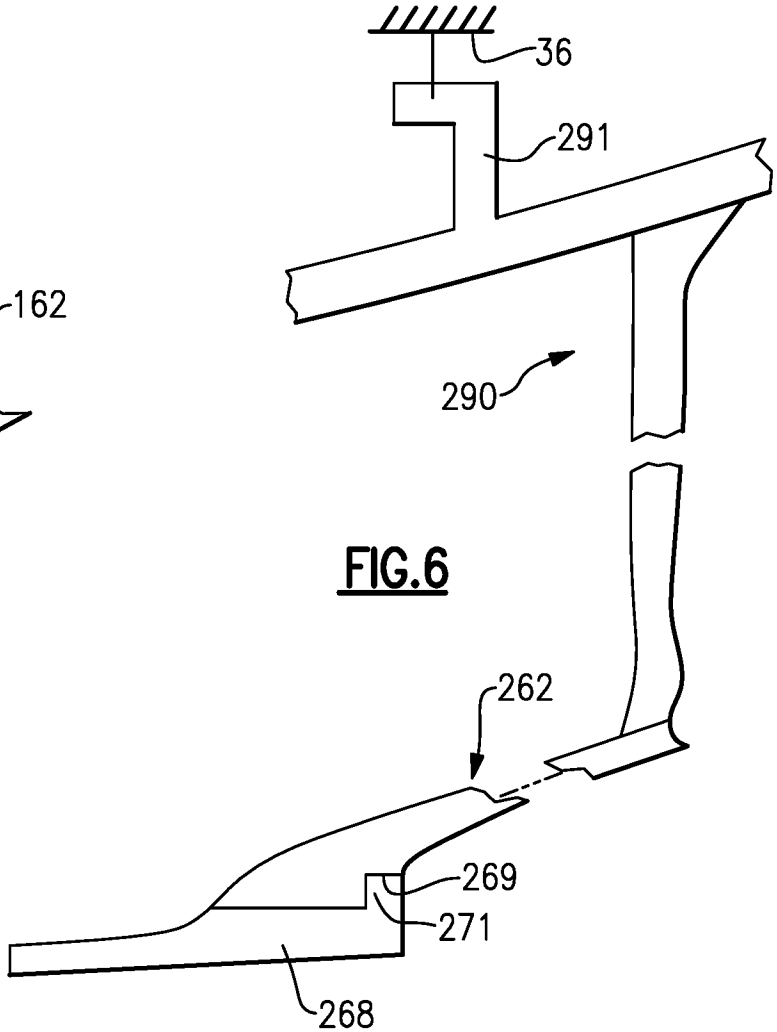
FIG. 6 is an enlarged, broken view of another ring configuration secured to another vane arrangement.

Referring to FIG. 6, discrete single vanes or cluster of vanes is shown at 290 and is supported or hung relative to the engine static structure 36 by an attachment feature, such as a hook 291. The vane segment 262 and ring 268 include complementary shaped interlocking features to prevent the ring 268 from migrating axially toward the blade. In the example, one of the interlocking features is a groove 269 and the other of the interlocking features is a tab 271. In another example, the interlocking features may be provided by conical surfaces that provide a wedge-like interface. The interlocking features may obviate the need for any additional mechanical securing elements, such as brazing and/or fasteners.

Although example embodiments have been disclosed, a worker of ordinary skill in this art would recognize that certain modifications would come within the scope of the claims. For that and other reasons, the following claims should be studied to determine their true scope and content.

What is claimed is:

1. A gas turbine engine comprising:

an engine static structure;

a compressor section;

a combustor fluidly connected downstream from the compressor section;

a turbine section fluidly connected downstream from the combustor and including high and low pressure turbine sections;

a vane pack arranged in one of the compressor or turbine sections, the vane pack including a reinforcement ring secured around an annular arrangement of vanes and extending proud of an axial end of the vanes to an end, the end interleaving with an adjacent rotating component to provide a seal; and a sealing ring supported by the engine static structure and engaged with the reinforcement ring, wherein the reinforcement ring is supported by the vane pack, and wherein the reinforcement ring and the vanes include interlocking features engaging one another and configured to prevent relative axial movement between the reinforcement ring and the vanes.

2. The gas turbine engine according to claim 1, wherein the vane pack is arranged in the turbine section.

3. The gas turbine engine according to claim 1, wherein the rotating component includes one of a pocket and a lip, the reinforcement ring providing the other of the pocket and the lip, the lip arranged in the pocket to provide the seal.

4. The gas turbine engine according to claim 3, wherein the rotating component is a stage of rotating blades provided by the high pressure turbine section, and the vane pack provides a mid-turbine frame.

5. The gas turbine engine according to claim 1, wherein the vanes are hung from the engine static structure.

6. The gas turbine engine according to claim 1, wherein the end includes an annular lip that is received in an annular pocket of the rotating component.

7. The gas turbine engine according to claim 1, wherein the reinforcement ring is secured to the vanes by at least one of a mechanical element or an interference fit.

8. The gas turbine engine according to claim 7, wherein the mechanical element includes at least one of a braze, a weld or fasteners.

9. The gas turbine engine according to claim 1, wherein the reinforcement ring is secured to an inner platform of the vanes.

10. The gas turbine engine according to claim 9, wherein the axial end is a leading edge.

11. A gas turbine engine comprising:

an engine static structure;

a compressor section;

a combustor fluidly connected downstream from the compressor section;

a turbine section fluidly connected downstream from the combustor and including high and low pressure turbine sections;

a vane pack arranged in one of the compressor or turbine sections, the vane pack including a reinforcement ring secured around an annular arrangement of vanes and extending proud of an axial end of the vanes to an end, the end interleaving with an adjacent rotating component to provide a seal; and a sealing ring supported by the engine static structure and engaged with the reinforcement ring, wherein the reinforcement ring is supported by the vane pack, and wherein the reinforcement ring is secured to the vanes by an interference fit.

12. The gas turbine engine according to claim 11, wherein the reinforcement ring and the vanes include interlocking features engaging one another and configured to prevent relative axial movement between the reinforcement ring and the vanes.

13. The gas turbine engine according to claim 11, wherein the vane pack is arranged in the turbine section.

14. The gas turbine engine according to claim 11, wherein the rotating component includes one of a pocket and a lip, the reinforcement ring providing the other of the pocket and the lip, the lip arranged in the pocket to provide the seal.

15. The gas turbine engine according to claim 14, wherein the rotating component is a stage of rotating blades provided by the high pressure turbine section, and the vane pack provides a mid-turbine frame.

16. The gas turbine engine according to 11, wherein the vanes are hung from the engine static structure.

17. The gas turbine engine according to claim 11, wherein the end includes an annular lip that is received in an annular pocket of the rotating component.

18. The gas turbine engine according to claim 11, wherein the reinforcement ring and the vanes include interlocking features engaging one another and configured to prevent relative axial movement between the reinforcement ring and the vanes.

19. The gas turbine engine according to claim 11, wherein the reinforcement ring is secured to an inner platform of the vanes.

20. The gas turbine engine according to claim 19, wherein the axial end is a leading edge.

* * * * *